US008090296B2

(12) United States Patent
Ito et al.

(10) Patent No.: US 8,090,296 B2
(45) Date of Patent: Jan. 3, 2012

(54) COUPLING MECHANISM FOR A PROCESS PORTION OF AN IMAGE FORMING APPARATUS

(75) Inventors: Tetsushi Ito, Nara (JP); Yoshiteru Kikuchi, Yamatokoriyama (JP); Yoshikazu Harada, Nara (JP); Norio Tomita, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 595 days.

(21) Appl. No.: 12/254,054

(22) Filed: Oct. 20, 2008

(65) Prior Publication Data

US 2009/0123181 A1 May 14, 2009

(30) Foreign Application Priority Data

Nov. 8, 2007 (JP) ..... 2007-290544

(51) Int. Cl.
*G03G 15/00* (2006.01)

(52) U.S. Cl. ..... 399/167; 399/36; 399/111; 192/89.2

(58) Field of Classification Search ..... 399/167, 399/36, 111; 192/82, 89.2
See application file for complete search history.

(56) References Cited

U.S. PATENT DOCUMENTS 6,453,135 B1 * 9/2002 Sameshima et al. ..... 399/110
6,463,135 B2 10/2002 Abrishami et al.
6,795,671 B2 * 9/2004 Matsuoka ..... 399/223
7,130,562 B2 * 10/2006 Foster et al. ..... 399/112
2006/0260902 A1 11/2006 Marumoto et al.

FOREIGN PATENT DOCUMENTS

| | | |
|---|---|---|
| JP | 11-126009 | 5/1999 |
| JP | 2000-221863 | 8/2000 |
| JP | 2001-142378 | 5/2001 |
| JP | 2004-125999 | 4/2004 |
| JP | 2006-350285 | 12/2006 |

* cited by examiner

*Primary Examiner* — David Gray
*Assistant Examiner* — Francis Gray
(74) *Attorney, Agent, or Firm* — Renner, Otto, Boisselle & Sklar, LLP

(57) ABSTRACT

There is provided an image forming apparatus that includes couplings for photoreceptor drums, couplings for waste toner transporting screws, and couplings for developing rollers, that transmit driving force to each of a plurality of driving shafts for driving a process portion that performs image formation by an electrophotographic method, and a plurality of coupling attaching/detaching members for attaching/detaching the plurality of coupling members, so as to drive the process portion. In the image forming apparatus, the plurality of coupling attaching/detaching members are provided so as to be movable independently, and the image forming apparatus includes a coupling attaching/detaching member driving mechanism that operates the coupling attaching/detaching members in association with each other.

6 Claims, 11 Drawing Sheets

COUPLING MECHANISM FOR A PROCESS PORTION OF AN IMAGE FORMING APPARATUS

This Nonprovisional application claims priority under 35 U.S.C. §119(a) on Patent Application No. 2007-290544 filed in Japan on 8 Nov. 2007, the entire contents of which are hereby incorporated by reference.

BACKGROUND OF THE INVENTION

1. Field of the Invention

The present invention relates to an image forming apparatus that performs image formation by an electrophotographic method, more particularly, to an image forming apparatus, wherein a coupling member for performing transmission of driving to a process portion is provided and an attachment/detachment operation thereof is performed by a coupling attaching/detaching member.

2. Description of the Prior Art

Conventionally, in an image forming apparatus that performs image formation by an electrophotographic method, in order to facilitate a replacement work of a replacement-required component, a mechanism for facilitating, for example, when replacing a component of a process portion (an image forming portion), an attachment/detachment work in the process portion, by detaching a coupling for applying driving force to the process portion.

A conventional technology discloses an image forming apparatus that includes a mechanism wherein a coupling member composed of a driving coupling and a driven coupling is used to transmit driving to a process portion, and the driving coupling and the driven coupling are attached/detached by an arm that slides the coupling member in a driving shaft direction in association with an open/close operation of a housing of the process portion (see Patent Literature 1: Japanese Patent Application Laid-Open No. 2000-221863).

However, when such an attaching/detaching mechanism is provided in a color image forming apparatus, the process portion has a plurality of driving shafts and the attaching/detaching mechanism needs to be provided for each shaft, thus posing a problem that the apparatus is enlarged.

SUMMARY OF THE INVENTION

The present invention has been made in view of the aforementioned conventional problem and an object of the present invention is to provide an image forming apparatus capable of reliably attaching/detaching a plurality of couplings without enlarging the image forming apparatus.

In order to solve the above problem, the image forming apparatus according to the present invention is configured as follows.

According to the first aspect of the present invention, an image forming apparatus that drives a process portion for performing image formation by an electrophotographic method includes: a plurality of coupling members for transmitting driving force to each of a plurality of driving shafts that drive the process portion; a plurality of coupling attaching/detaching members for attaching/detaching the plurality of coupling members; and a coupling attaching/detaching member driving mechanism for operating the plurality of coupling attaching/detaching members in association with each other, and is characterized in that the coupling member is configured by a driving coupling and a driven coupling, and the plurality of coupling attaching/detaching members are provided so as to be movable independently.

According to the second aspect of the present invention, an image forming apparatus is characterized in that the coupling attaching/detaching member driving mechanism includes an interlocking member that operates in association with an open/close operation of a cover that covers the process portion, and the interlocking member drives the coupling attaching/detaching member in association with the open/close operation of the cover to perform an attachment/detachment operation of the coupling member.

According to the third aspect of the present invention, an image forming apparatus is characterized in that the coupling attaching/detaching member driving mechanism includes a driving transmission member that transmits driving force, among the plurality of coupling attaching/detaching members, to a second coupling attaching/detaching member through a first coupling attaching/detaching member.

According to the fourth aspect of the present invention, an image forming apparatus is characterized in that the driving transmission member is an intermediate gear that transmits driving force so that an operating direction of the first coupling attaching/detaching member is opposite to an operating direction of the second coupling attaching/detaching member.

According to the fifth aspect of the present invention, an image forming apparatus is characterized in that the coupling attaching/detaching member has a function of performing attachment/detachment operations of the plurality of coupling members simultaneously. That is, it is preferable that attachment/detachment operation of the plurality of coupling members may be performed by a common coupling attaching/detaching member.

According to the sixth aspect of the present invention, an image forming apparatus is characterized in that the process portion includes a plurality of photoreceptor drums having toner images formed thereon and a plurality of developing rollers for supplying toner to the photoreceptor drums, and includes, as the driving shafts, driving shafts of the plurality of photoreceptor drums and driving shafts of the plurality of developing rollers, and among the plurality of coupling attaching/detaching members, the first coupling attaching/detaching member attaches/detaches coupling members of the driving shafts of the plurality of photoreceptor drums and the second coupling attaching/detaching member attaches/detaches coupling members of the driving shafts of the plurality of developing rollers.

According to the seventh aspect of the present invention, an image forming apparatus is characterized in that the process portion includes a plurality of photoreceptor drums having toner images formed thereon and a plurality of cleaning apparatuses for removing toner remaining on the photoreceptor drums, the cleaning apparatuses include waste toner transporting screws for transporting collected waste toner, and includes, as the plurality of driving shafts, driving shafts of the plurality of the photoreceptor drums and driving shafts of the plurality of waste toner transporting screws, and among the plurality of coupling attaching/detaching members, the first coupling attaching/detaching member attaches/detaches coupling members of the driving shafts of the plurality of photoreceptor drums and coupling members of the driving shafts of the plurality of waste toner transporting screws.

According to the eighth aspect of the present invention, an image forming apparatus is characterized in that the image forming apparatus includes a transfer portion for transferring the toner images formed on the photoreceptor drums through an intermediate transfer belt onto a recording medium, and the interlocking member drives the coupling attaching/detaching member in association with the open/close operation of the cover to performs the attachment/detachment operation of the coupling member for transmitting driving force to a driving shaft of the intermediate transfer belt.

Furthermore, according to the first aspect of the present invention, it is possible to operate the plurality of coupling attaching/detaching members without requiring a complicated mechanism, and by providing the plurality of coupling attaching/detaching members so as to be movable independently, it is possible to adjust initial positions of the coupling attaching/detaching members, thus making it possible to perform attachment/detachment of the coupling members reliably. The structure of the first aspect makes it possible to suppress increasing in the number of components, resulting that it is possible to provide an image forming apparatus capable of attaching/detaching the plurality of couplings reliably without enlarging the image forming apparatus.

Furthermore, according to the second aspect of the present invention, it is possible to easily perform the attachment/detachment operation of the coupling members without being provided with another driving means.

Furthermore, according to the third aspect of the present invention, it is possible to drive the other coupling attaching/detaching member without being provided with another driving means.

Furthermore, according to the fourth aspect of the present invention, it is possible to realize the driving transmission member with a simple configuration and space saving.

Furthermore, according to the fifth aspect of the present invention, it is possible to suppress increasing in the number of components and in the size of the apparatus by sharing the components.

Furthermore, according to the sixth aspect of the present invention, it is possible to perform the attachment/detachment operations of the coupling members of the driving shafts of the photoreceptor drums and the driving shafts of the developing rollers simultaneously with a simple configuration.

Furthermore, according to the seventh aspect of the present invention, it is possible to perform the attachment/detachment operations of the coupling members of the driving shafts of the photoreceptor drums and the driving shafts of the waste toner transporting screws simultaneously with a simple configuration.

Furthermore, according to the eighth aspect of the present invention, it is possible to perform the attachment/detachment operations of the coupling members of the driving shaft of the process portion and the driving shaft of the transfer portion simultaneously.

DESCRIPTION OF THE PREFERRED EMBODIMENTS

The embodiments of the present invention will hereinafter be described in detail with reference to the drawings.

Figure 1:
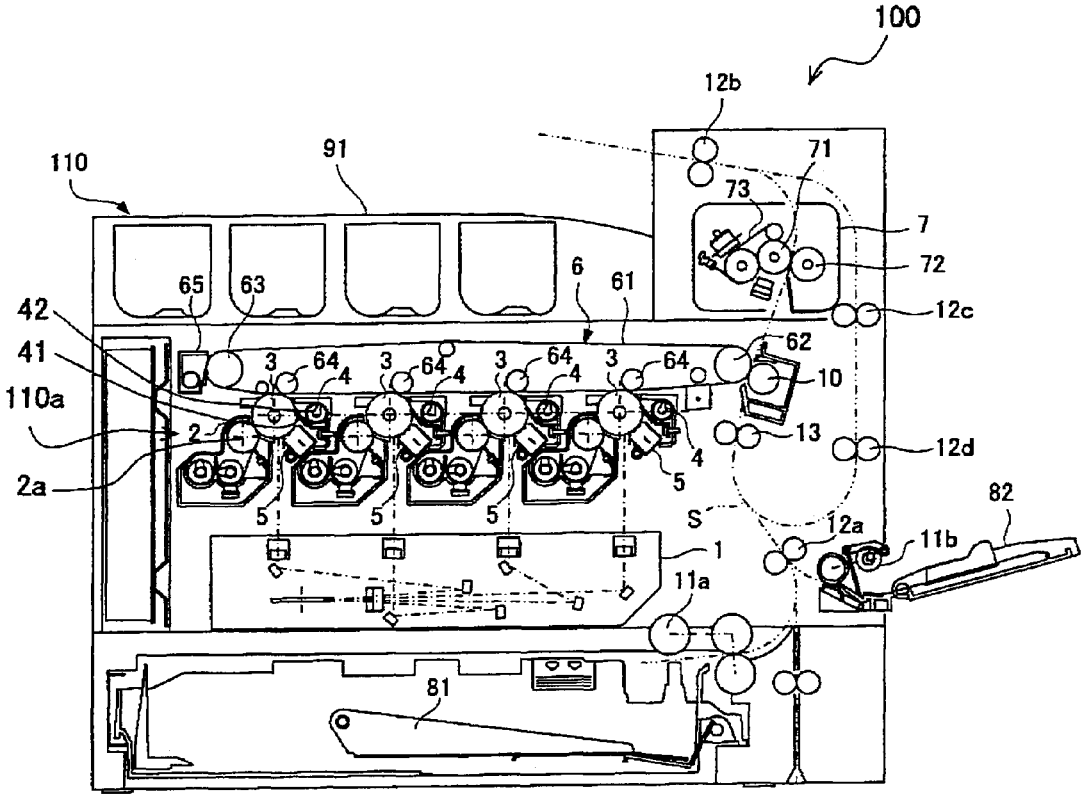
FIG. 1 is an illustrative view showing the configuration of an image forming apparatus according to the embodiment of the present invention.
Figure 2:
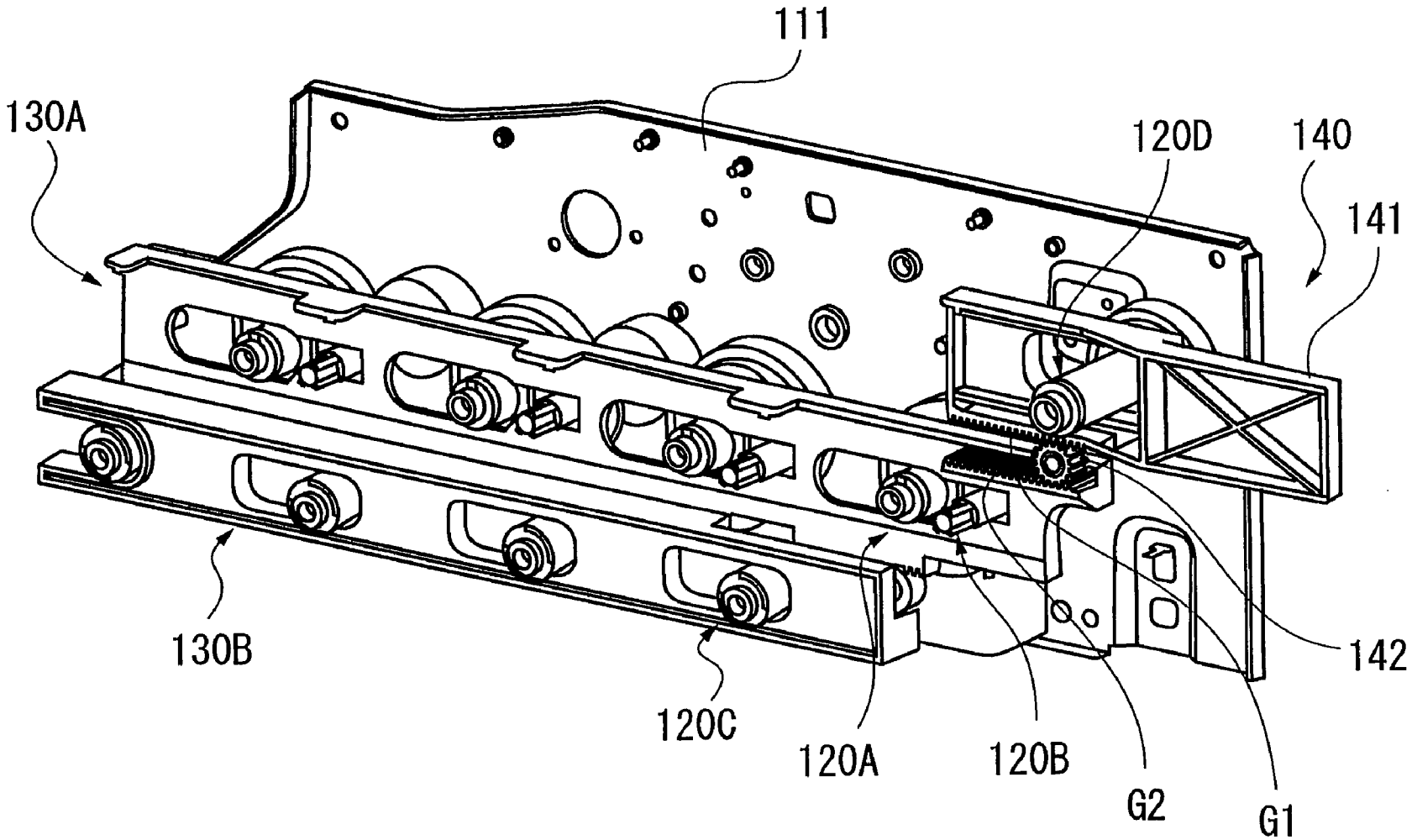
FIG. 2 is an illustrative view showing the configuration of a driving portion of a process portion in the image forming apparatus.

FIG. 1 is an illustrative view showing the configuration of an image forming apparatus according to the embodiment of the present invention, and FIG. 2 is an illustrative view showing the configuration of a driving portion of a process portion in the image forming apparatus.

As shown in FIG. 1, an image forming apparatus 100 according to the present embodiment is an image forming apparatus for performing image formation by an electrophotographic method, and as shown in FIG. 2, the image forming apparatus includes couplings for photoreceptor drums 120A, couplings for waste toner transporting screws 120B, and couplings for developing rollers 120C, that transmit driving force to a plurality of driving shafts for driving a process portion 110*a* which performs image forming, and coupling attaching/detaching members 130A and 130B, that attach/detach the couplings for photoreceptor drums 120A, the couplings for waste toner transporting screws 120B, and the couplings for developing rollers 120C, so as to drive the process portion 110*a*, wherein each of the coupling attaching/detaching members 130A and 130B is provided so as to be movable independently, and a coupling attaching/detaching member driving mechanism 140 that causes the coupling attaching/detaching members 130A and 130B to be operated in linkage with each other.

First, the overall configuration of the image forming apparatus 100 according to the present embodiment will be described.

As shown in FIG. 1, the image forming apparatus 100 forms multicolor images and monochrome images on predetermined sheets (papers) according to image data transmitted externally, and includes an apparatus main body 110.

The apparatus main body 110 is mainly configured by having an exposure unit 1, developing unit 2, photoreceptor drums 3, cleaner units 4, charger 5, an intermediate transfer belt unit 6, a fixing unit 7, a paper feed cassette 81, a paper output tray 91, and the like.

Image data handled by the image forming apparatus 100 corresponds to a color image that uses colors of black (K), cyan (C), magenta (M), and yellow (Y).

Hence, the development devices 2, the photoreceptor drums 3, the charging devices 5, and the cleaner units 4 are respectively provided as many as four so as to form four kinds of latent images corresponding to each color, and each corresponds to black, cyan, magenta, and yellow, respectively. These components form four image stations (image forming portions).

The exposure unit 1 corresponds to an image writing apparatus relating to the present invention and is configured as a laser scanning unit (LSU) equipped with a laser irradiating portion, a reflecting mirror, and the like.

The exposure unit 1 is provided with a polygon mirror for scanning laser beams, and optical elements such as lenses and mirrors for guiding the laser lights reflected by the polygon mirror to the photoreceptor drums 3. For example, the exposure unit 1 may use an EL or LED writing head in which light emitting elements are arranged in an array.

Moreover, the exposure unit 1 has a function of exposing the charged photoreceptor drums 3 according to input image data to form electrostatic latent images corresponding to the image data on surfaces of the photoreceptor drums 3. The developing units 2 include developing rollers 2*a* for supplying an appropriate amount of toner to the photoreceptor drums 3, and visualize the electrostatic latent images formed on each of the photoreceptor drums 3 by using toners of four colors (YMCK).

The photoreceptor drums 3 have a cylindrical shape and are arranged above the exposure unit 1. Arranged along the outer peripheral surfaces of the photoreceptor drums 3 are the cleaner units 4, the charger 5 as electric field generators, and the developing units 2.

The cleaner units 4 remove and collect toner remaining on the surfaces of the photoreceptor drums 3 after development and image transfer. Each of the cleaner units 4 includes a cleaning blade 41 and a waste toner transporting screw 42.

The chargers 5 are charging means for charging the surfaces of the photoreceptor drums 3 uniformly at a predetermined potential. Note that, instead of the charger-type charger 5, roller type or brush type chargers in a contact type may be used.

The intermediate transfer belt unit 6 that is disposed above the photoreceptor drums 3 includes an intermediate transfer belt 61, an intermediate transfer belt driving roller 62, an intermediate transfer belt driven roller 63, intermediate transfer rollers 64, and an intermediate transfer belt cleaning unit (a cleaning apparatus) 65.

The intermediate transfer belt driving roller 62, the intermediate transfer belt driven roller 63, and the intermediate transfer rollers 64 are configured to support and tension the intermediate transfer belt 61 to circulatively drive the belt.

The intermediate transfer rollers 64 apply a transfer bias to transfer toner images of the photoreceptor drums 3 onto the intermediate transfer belt 61, and are disposed at four locations corresponding to 5 each color for YMCK.

The intermediate transfer belt 61 is formed so as to be endless using a film whose thickness is around 100 μm to 150 μm, and is in contact with each of the photoreceptor drums 3. Moreover, the intermediate transfer belt 61 has a function of forming a colored toner image (a multi-color toner image) by serially superimposing and transferring, onto the intermediate transfer belt 61, toner images with respective colors, formed on the photoreceptor drums 3.

Toner images are transferred from the photoreceptor drums 3 onto the intermediate transfer belt 61 by the intermediate transfer rollers 64 that are in contact with a rear side of the intermediate transfer belt 61. A transfer bias having a high voltage (a high voltage having a polarity (+) opposite to a charging polarity (−) of toner) is applied to the intermediate transfer rollers 64 to transfer the toner images.

Each of the intermediate transfer rollers 64 is a roller made of a metal (for example, stainless steel) shaft, whose diameter is 8 through 10 mm, as a base and a surface of the shaft is covered with a conductive elastic member (for example, EPDM, urethane foam, and the like). The conductive elastic member enables a high voltage to be applied to the intermediate belt 61 uniformly.

Although roller-shaped intermediate transfer rollers 64 are used as a transfer electrode in the present embodiment, in addition, a brush-shaped electrode and the like can be used.

As described above, toner images visualized on the photoreceptor drums 3 according to each hue are laminated on the intermediate transfer belt 61. The image information that the toner images are laminated in this way is transferred onto a paper by a transfer roller 10 that is disposed at a portion where the paper is in contact with the intermediate transfer belt 61 by rotation of the intermediate transfer belt 61.

At this time, the intermediate transfer belt 61 is press-contact with the transfer roller 10 with a predetermined nip, and a voltage for transferring the toner onto the paper, that is, a high voltage having a polarity (+) opposite to a charging polarity (−) of toner, is applied to the transfer roller 10.

Moreover, in order to constantly obtain the predetermined nip by the transfer roller 10, one of the transfer roller 10 and the intermediate transfer belt driving roller 62 is formed of a hard material (metal or the like) the other is formed of a soft material such as an elastic roller or the like (elastic rubber roller, foamed resin roller etc.).

Moreover, as described above, toner attached to the intermediate transfer belt 61 due to contact with the photoreceptor drums 3 or toner remaining on the intermediate transfer belt 61 because transfer onto a paper was not performed by the transfer roller 10 causes mixture of colors of toner in the following step, and therefore, it is so configured that the attached toner or remaining toner is removed and collected by the intermediate transfer belt cleaning unit 65.

The paper feed cassette 81 is a tray to store sheets used for image formation, and is disposed under the exposure unit 1 of the apparatus main body 110. In addition, sheets used for image formation can be placed also on a manual paper feed cassette 82 that is disposed on the outer side face of the apparatus main body 110.

The paper output tray 91 disposed in the upper part of the apparatus main body 110 is a tray to place printed sheets so that printed sides of the sheets face downward.

Moreover, the apparatus main body 110 is provided with approximately vertical shaped sheet transport path S to convey sheets in the paper feed cassette 81 and the manual paper feed cassette 82 through the transfer roller 10 and the fixing unit 7 to the paper output tray 91.

In a vicinity of the sheet transport path S extending from the paper feed cassette 81 through the manual paper feed cassette 82 to the paper output tray 91, there are provided pickup rollers 11*a* and 11*b*, a plurality of transport rollers 12*a* to 12*d*, a registration roller 13, the transfer roller 10, the fixing unit 7, and the like.

The transport rollers 12*a* to 12*d* are small rollers to facilitate/assist transportation of a sheet and are disposed in plural places along the sheet transport path S.

The pickup roller 11*a* is disposed near an end of the paper feed cassette 81 and picks up sheets one by one from the paper feed cassette 81 to supply to the sheet transport path S.

The pickup roller 11*b* is disposed near an end of the manual paper feed cassette 82 and picks up sheets one by one from the manual paper feed cassette 82 to supply to the sheet transport path S.

The registration roller 13 has a function of temporarily holding a sheet transported through the sheet transport path S and transporting the sheet to the transfer roller 10 at such a timing that front end of toner image on the photoreceptor drums 3 meets the front end of the sheet.

The fixing unit 7 includes a heat roller 71 and a pressing roller 72.

The heat roller 71 and the pressing roller 72 rotate so as to sandwich a sheet therebetween.

The heat roller 71 is set so as to have a predetermined fixing temperature by a control portion based on a signal from a temperature detecting device (not shown), and has a function of performing heating and pressing of toner for a sheet together with the pressing roller 72, and thereby causing multi-colored toner images transferred onto the sheet to be fused/mixed/pressed, so as to heat and fix the toner images onto the sheet. In addition, the fixing unit 7 is provided with an external heat belt 73 for externally heating the heat roller 71.

Next, the sheet transport path in the image forming apparatus 100 will be described in detail.

As describe above, the image forming apparatus 100 is provided with the paper feed cassette 81 that stores sheets in advance and the manual paper feed cassette 82. In order to feed sheets from these paper feed cassettes 81 and 82, each of the pickup rollers 11*a* and 11*b* leads sheets one by one to the sheet transport path S.

In a case where single sided printing is requested for a sheet, a sheet transported from each of the paper feed cassettes 81 and 82 is transported to the registration roller 13 by the transport roller 12*a* in the sheet transport path S, and transported to the transfer roller 10 at such a timing that front end of the sheet meets the front end of image information on the intermediate transfer belt 61 by the registration roller 13, so that the image information (toner image) is transported onto the sheet.

Thereafter, the sheet having the toner image transferred thereon passes through the fixing unit 7 so as to fuse and fix unfixed toner on the sheet, and then the sheet is discharged through the transport roller 12b onto the paper output tray 91.

On the other hand, in a case where double sided printing is requested for a sheet, a back end of the sheet having been subject to single side printing and having passed through the fixing unit 7 is nipped by the transport roller 12*b*, and the sheet is then led to the transport rollers 12*c* and 12*d* by inverse rotation of the paper transport roller 12*b*. Subsequently, the sheet is transported through the registration roller 13 to the transfer roller 10 and the image information (the toner image) is transferred onto a back face of the sheet. The sheet having the toner image transferred onto the back face thereof passes through the fixing unit 7 again so as to fuse and fix unfixed toner with heat, and is discharged through the transport roller 12*b* onto the paper output tray 91.

Next, detailed description will be given for the configuration of a driving portion of the characteristic process portion 110*a* that is employed in the image forming apparatus 100 with reference to the drawings.

In the image forming apparatus 100 according to the present embodiment, as the configuration of the driving portion of the process portion 110*a*, as shown in FIG. 2, a base plate 111 formed on the side face of the apparatus main body 110 is provided with a driving motor and a gear (not shown), and further equipped with the couplings (the coupling members) for photoreceptor drums 120A that transmit driving to the photoreceptor drums 3, the couplings (the coupling members) for waste toner transporting screws 120B that transmit driving to the waste toner transporting screws 42 in the cleaner units 4, the couplings (the coupling members) for developing rollers 120C that transmit driving to the developing rollers 2*a*, and a coupling (a coupling member) for an intermediate transfer belt 120D that transmits driving to the intermediate transfer belt driving roller 62.

The couplings for photoreceptor drums 120A are approximately horizontally disposed in parallel at four locations for each color of Y, M, C, and K.

The couplings for waste toner transporting screws 120B are disposed adjacently to each of the couplings for photoreceptor drums 120A in approximately horizontal direction.

The couplings for developing rollers 120C are disposed below each of the couplings for photoreceptor drums 120A and the couplings for waste toner transporting screws 120B.

The coupling for an intermediate transfer belt 120D is disposed above the couplings for photoreceptor drums 120A in a vicinity of the apparatus main body side.

These couplings are configured by a driving coupling provided in a driving side (a side of the base plate 111) and a driven coupling provided in a driven side (that is, a side of the photoreceptor drums 3, the waste toner transporting screws 42, the developing rollers 2*a*, and the intermediate transfer belt driving roller 62).

The couplings for photoreceptor drums 120A, the couplings for waste toner transporting screws 120B, and the couplings for developing rollers 120C are disposed at four locations, respectively, for each color of Y, M, C, and K. Each of the couplings at a same location of the four locations are approximately horizontally disposed in parallel.

Each four pieces of the couplings for photoreceptor drums 120A, and the couplings for waste toner transporting screws 120B, disposed at four locations, are attached/detached by the coupling attaching/detaching member 130A.

On the other hand, the couplings for developing rollers 120C disposed at four locations are attached/detached by the coupling attaching/detaching member 130B.

Moreover, the coupling for an intermediate transfer belt 120D is attached/detached by a coupling attachment/detachment driving member (an interlocking member) 141 that forms a part of the coupling attaching/detaching member driving mechanism 140.

Next, the coupling attaching/detaching members 130A and 130B and the coupling attaching/detaching member driving mechanism 140, that are characteristic, according to the present embodiment will be described with reference to the drawings.

Figure 3:
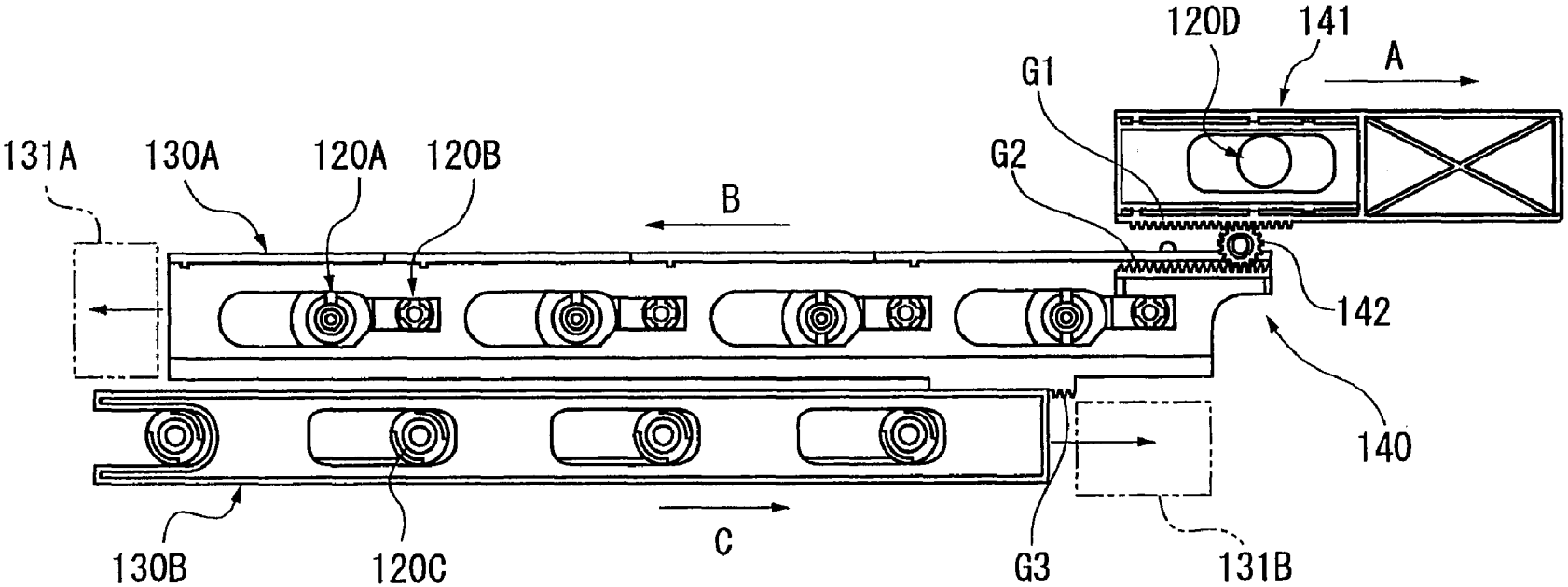
FIG. 3 is an illustrative view showing the configuration of coupling attaching/detaching members and a coupling attaching/detaching member driving mechanism, that are characteristic and configure the image forming apparatus.
Figure 4:
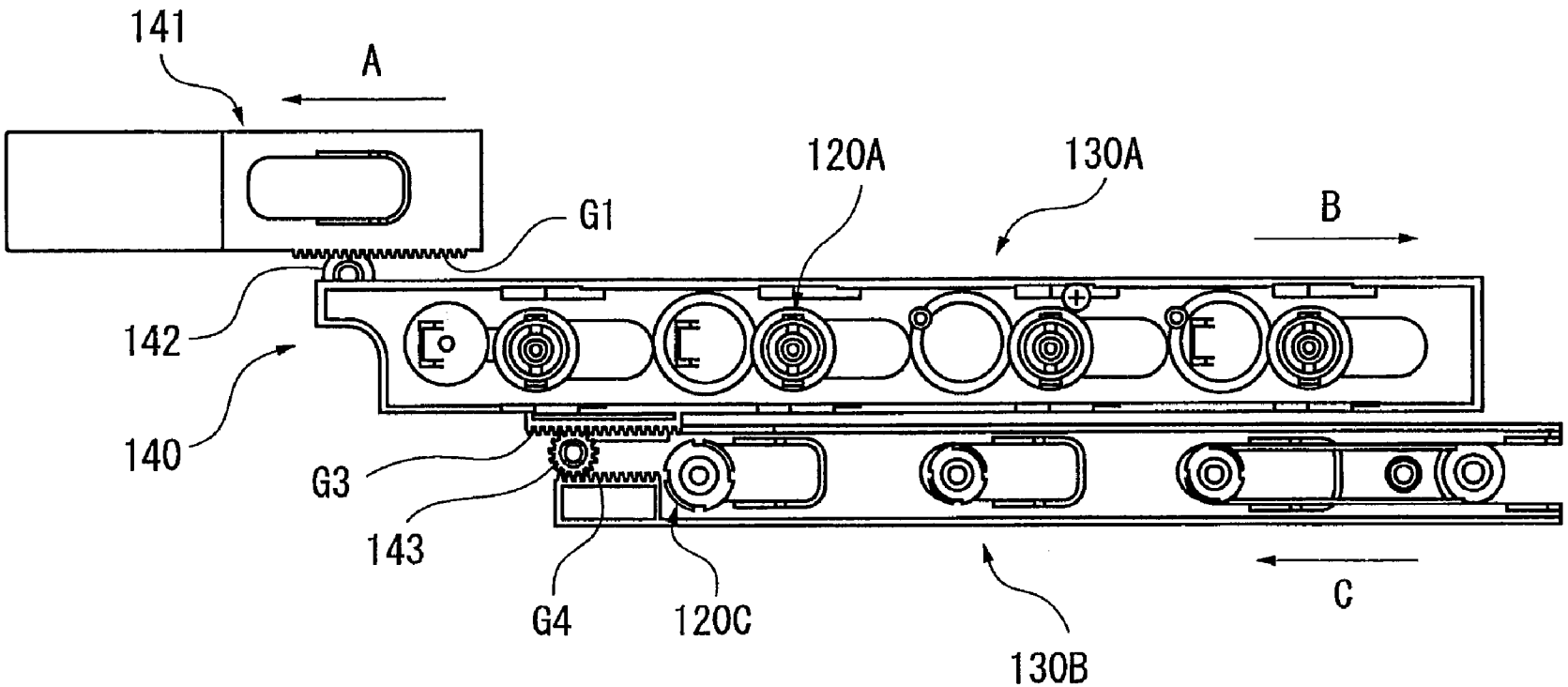
FIG. 4 is an illustrative view of the configuration of the coupling attaching/detaching members and the coupling attaching/detaching member driving mechanism when viewed from the inside of the apparatus.
Figure 5:
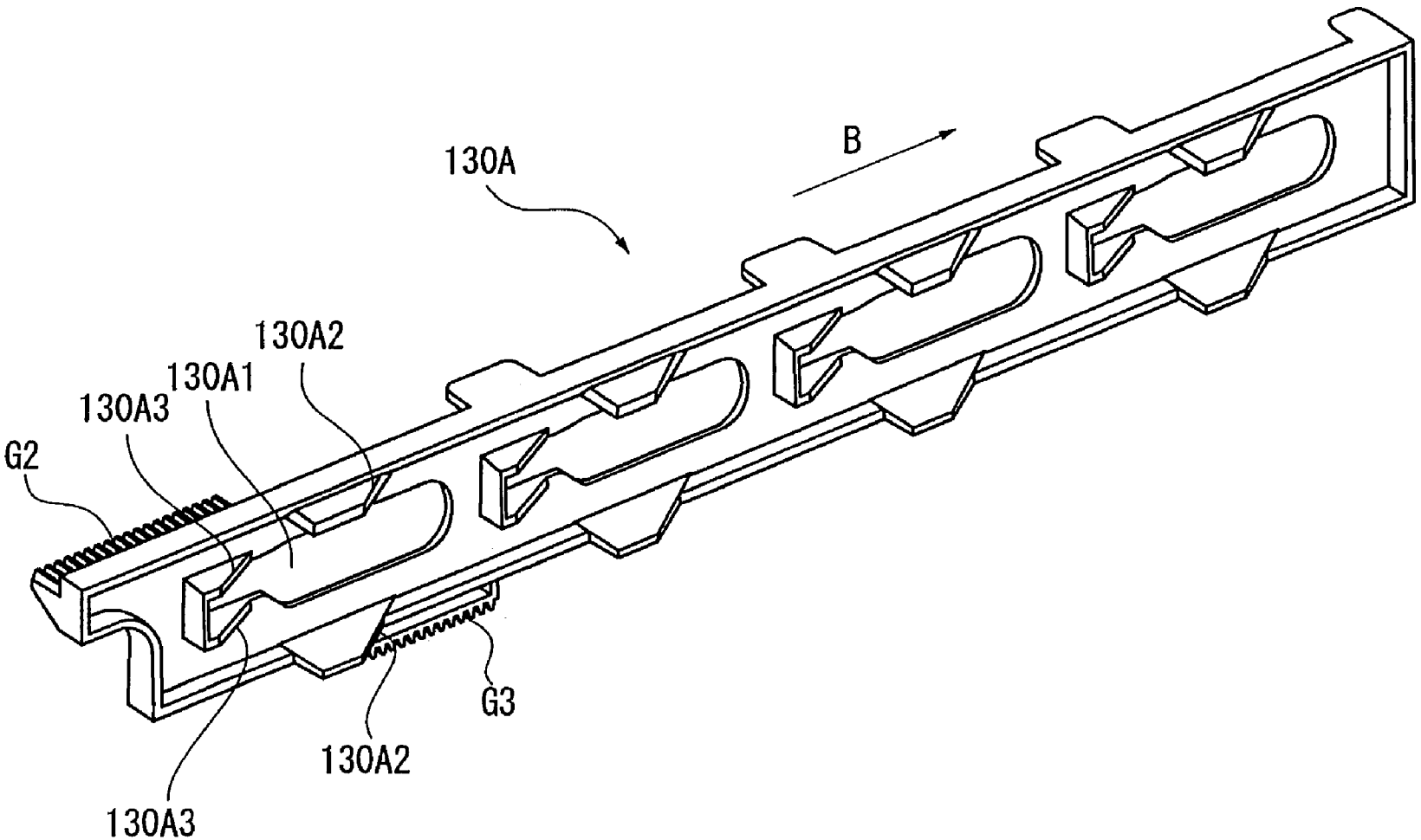
FIG. 5 is an illustrative view (a rear side view when viewed from the apparatus side) showing the configuration of the coupling attaching/detaching members that correspond to couplings for photoreceptor drums and couplings for waste toner transporting screws according to the present embodiment.
Figure 6:
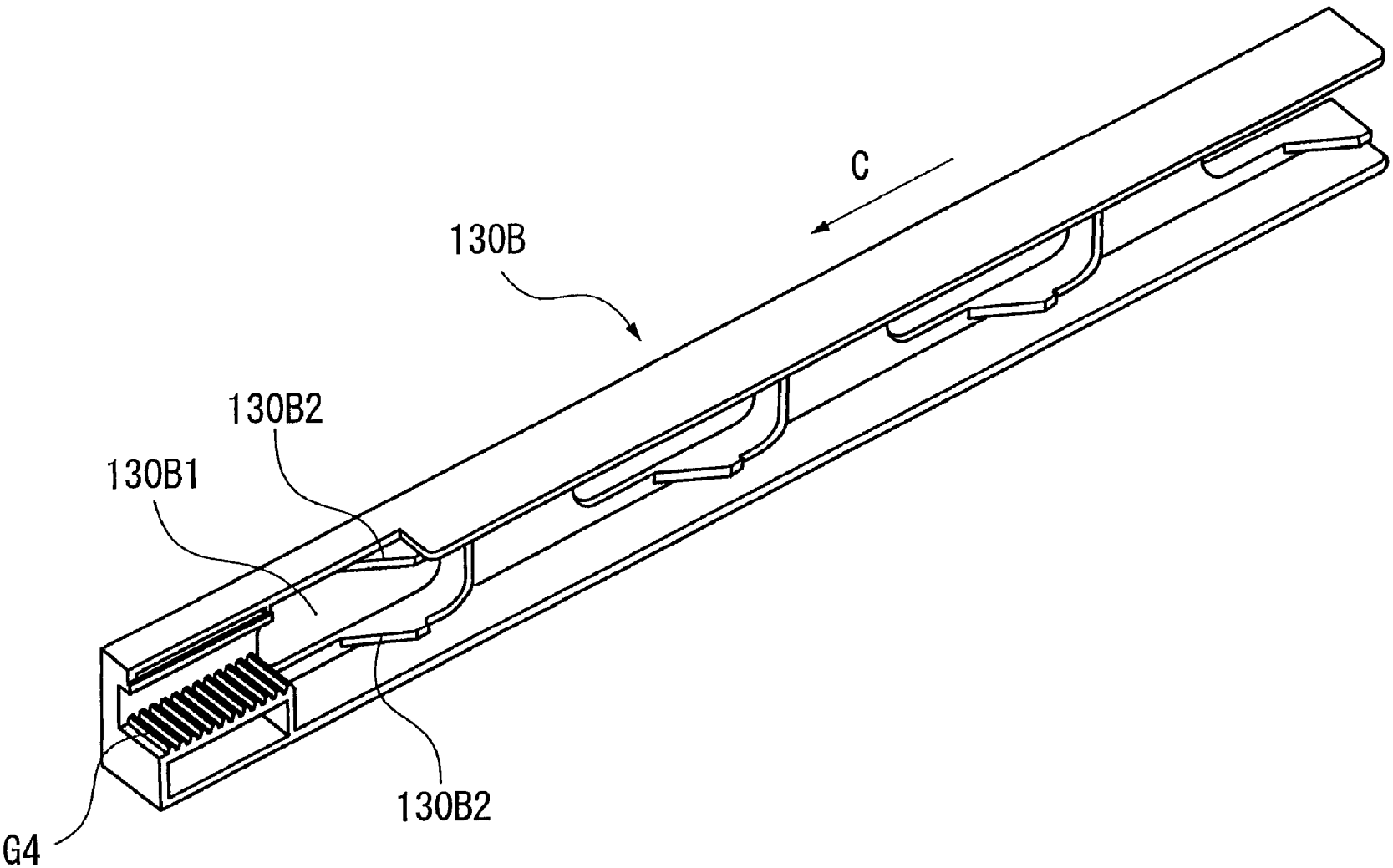
FIG. 6 is an illustrative view (a rear side view when viewed from the apparatus side) showing the configuration of the coupling attaching/detaching members that correspond to couplings for developing rollers according to the present embodiment.
Figure 7:
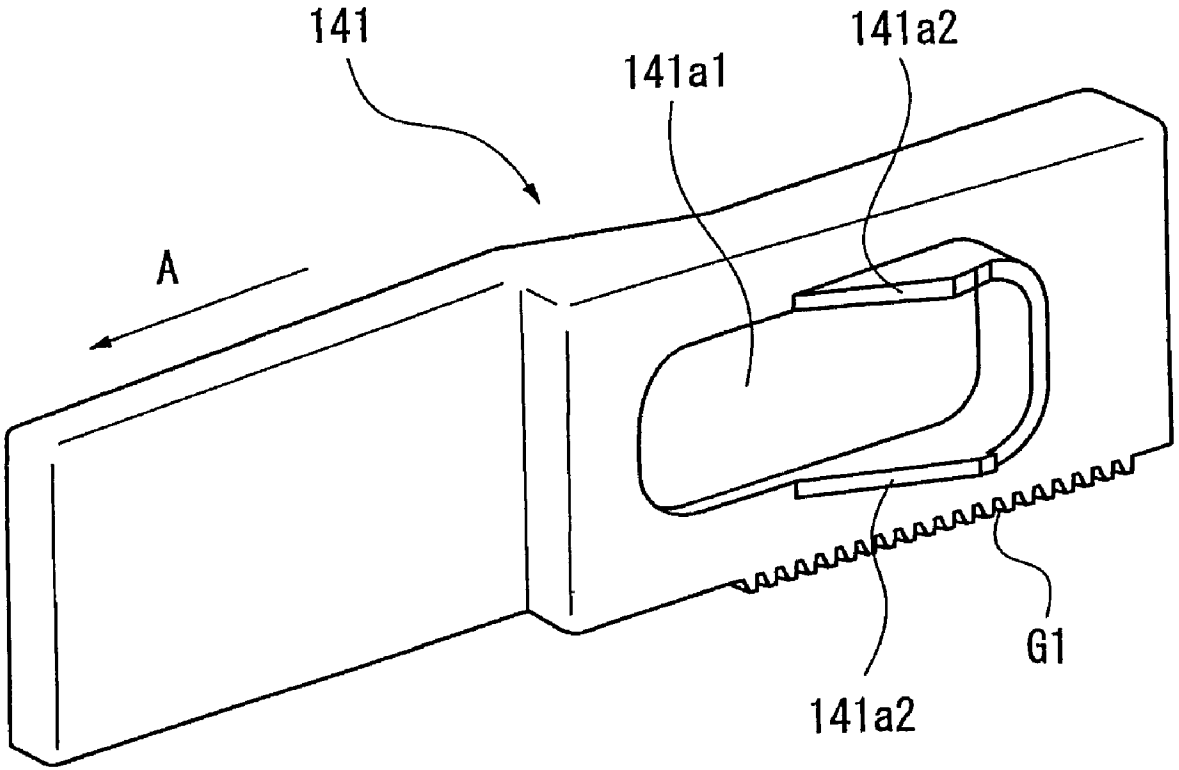
FIG. 7 is an illustrative view (a rear side view when viewed from the apparatus side) showing the configuration of a coupling attachment/detachment driving member that constitutes the attaching/detaching member driving mechanism.

FIG. 3 is an illustrative view showing the configuration of the coupling attaching/detaching members and the coupling attaching/detaching member driving mechanism according to the present embodiment, that are characteristic and constitute the image forming apparatus, FIG. 4 is an illustrative view of the configuration of the coupling attaching/detaching members and the coupling attaching/detaching member driving mechanism shown in FIG. 3, when viewed from the inside of the apparatus, FIG. 5 is an illustrative view (a rear side view when viewed from the apparatus side) showing the configuration of the coupling attaching/detaching members that correspond to the couplings for photoreceptor drums and the couplings for waste toner transporting screws according to the present embodiment, FIG. 6 is an illustrative view (a rear side view when viewed from the apparatus side) showing the configuration of the coupling attaching/detaching members that correspond to the couplings for developing rollers according to the present embodiment, and FIG. 7 is an illustrative view (a rear side view when viewed from the apparatus side) showing the configuration of the coupling attaching/detaching members that constitute the attaching/detaching member driving mechanism.

As shown in FIGS. 3 and 4, the coupling attaching/detaching member 130A is formed long in the approximate horizontal direction along the couplings for photoreceptor drums 120A and the couplings for waste toner transporting screws 120B at four locations, respectively, that are approximately horizontally disposed in parallel, and slides in a horizontal direction so that the couplings for photoreceptor drums 120A and the couplings for waste toner transporting screws 120B are attached/detached.

The coupling attaching/detaching member 130B is formed long in approximate horizontal direction along the couplings for developing rollers 120C at four locations, that are approximately horizontally disposed in parallel, and slides in a horizontal direction so that the couplings for developing rollers 120C are attached/detached.

The coupling attachment/detachment driving member 141 is formed long in the approximate horizontal direction, and slides in a horizontal direction so that the coupling for an intermediate transfer belt 120D is attached/detached.

The coupling attachment/detachment driving member 141 slides in a direction indicated by the arrow A in association with an open/close operation of a front cover 113, which will be described below, that covers the process portion (refer to FIG. 11).

The coupling attaching/detaching members 130A and 130B and the coupling attachment/detachment driving member 141 are provided such that, as shown in FIG. 3, the coupling attachment/detachment driving member 141 is disposed at an upper part in a front view, and the coupling attaching/detaching member 130A is disposed therebelow, and further the coupling attaching/detaching member 130B is disposed below the coupling attaching/detaching member 130A, where each of which is disposed in approximate horizontal direction and in parallel.

The coupling attachment/detachment driving member 141 and the coupling attaching/detaching member 130A are disposed so that each end of which faces to each other, the coupling attachment/detachment driving member 141 is formed with a rack gear G1 at a lower part thereof, and the coupling attaching/detaching member 130A facing the rack gear G1 is formed with a rack gear G2 at an upper end thereof.

A first interlocking gear (a driving transmission member) 142 is disposed between the rack gears G1 and G2 as an intermediate gear that meshes with each of the gears. The first interlocking gear 142 is supported rotatably in the apparatus main body side.

The first interlocking gear 142 causes the coupling attaching/detaching member 130A to slide when driving force (moving force) by the coupling attachment/detachment driving member 141 is transmitted from the rack gear G1 through the first interlocking gear 142 to the rack gear G2. That is, when the coupling attachment/detachment driving member 141 slides in a direction indicated by the arrow A, driving is applied so that the coupling attaching/detaching member 130A slides in a direction indicated by the arrow B by the first interlocking gear 142.

As shown in FIG. 4, the coupling attaching/detaching member 130A and the coupling attaching/detaching member 130B are disposed so that a lower end of the coupling attaching/detaching member 130A and an upper end of the coupling attaching/detaching member 130B face to each other, and the coupling attaching/detaching member 130A is formed with a rack gear G3 at the lower end thereof and the coupling attaching/detaching member 130B facing the rack gear G3 is formed with a rack gear G4 at one end thereof.

A second interlocking gear (a driving transmission member) 143 is disposed between the rack gears G3 and G4 as an intermediate gear that meshes with each of the gears. The second interlocking gear 143 is supported rotatably in the apparatus main body side.

The second interlocking gear 143 causes the coupling attaching/detaching member 130B to slide when driving force (moving force) by the coupling attaching/detaching member 130A is transmitted from the rack gear G3 through the second interlocking gear 143 to the rack gear G4. That is, when the coupling attaching/detaching member 130A slides in a direction indicated by the arrow B, driving is applied so that the coupling attaching/detaching member 130B slides in a direction indicated by the arrow C by the second interlocking gear 143.

The coupling attaching/detaching member driving mechanism 140 for operating the coupling attaching/detaching members 130A and 130B includes, as a part of the configuration thereof, the coupling attachment/detachment driving member 141 that operates in association with an open/close operation of the front cover 113, as well as the rack gears G1, G2, G3, and G4, that are provided in the coupling attaching/detaching members 130A and 130B, the first interlocking gear 142, and the second interlocking gear 143.

As described above, the coupling attaching/detaching members 130A and 130B and the coupling attachment/detachment driving member 141 are disposed, and therefore, as shown in FIG. 3, moving spaces 131A and 131B are provided in a side of a traveling direction of the coupling attaching/detaching member 130A and the coupling attaching/detaching member 130B that move when the coupling attachment/detachment driving member 141 slides. This prevents interference with other components.

Next, the configuration of the coupling attaching/detaching member 130A, the coupling attaching/detaching member 130B, and the coupling attachment/detachment driving member 141 will be described in detail.

The coupling attaching/detaching member 130A is formed in a long rectangular shape in the approximate horizontal direction in a state of being mounted on the base plate 111 (FIG. 2), as shown in FIG. 5, and is formed with attachment holes 130A1 through which the couplings for photoreceptor drums 120A and the couplings for waste toner transporting screws 120B are attached, inclined portions 130A2 corresponding to the couplings for photoreceptor drums 120A, and inclined portions 130A3 corresponding to the couplings for waste toner transporting screws 120B.

The attachment holes 130A1, the inclined portions 130A2, and the inclined portions 130A3 are disposed in parallel at four locations along a longitudinal direction corresponding to the couplings for photoreceptor drums 120A and the couplings for waste toner transporting screws 120B, each disposed at four locations.

The attachment holes 130A1 are formed as long slots in the longitudinal direction, so that the coupling attaching/detaching member 130A can slide in the longitudinal direction, in a state where the couplings for photoreceptor drums 120A and the couplings for waste toner transporting screws 120B are mounted.

The inclined portions 130A2 are formed projectingly, each of which has a same shape, in an upper end side and a lower end side of the coupling attaching/detaching member 130A across the attachment holes 130A1, and are disposed between the driving-side coupling and the driven-side coupling that constitute the couplings for photoreceptor drums 120A.

That is, by sliding the coupling attaching/detaching member 130A to the couplings for photoreceptor drums 120A, the inclined portions 130A2 come into spaces between the driving-side coupling and the driven-side coupling so as to perform attachment/detachment operations of the couplings for photoreceptor drums 120A.

The inclined portions 130A3 are disposed between the driving-side coupling and the driven-side coupling that constitute the couplings for waste toner transporting screws 120B. In addition, by sliding the coupling attaching/detaching member 130A along the couplings for waste toner transporting screws 120B, the inclined portions 130A3 come into spaces between the driving-side coupling and the driven-side coupling so as to perform attachment/detachment operations of the couplings for waste toner transporting screws 120B.

The coupling attaching/detaching member 130B is formed in a long rectangular shape in the approximate horizontal direction in a state of being mounted on the base plate 111, as shown in FIG. 6, and is formed with attachment holes 130B1 through which the couplings for developing rollers 120C are attached, and inclined portions 130B2 corresponding to the couplings for developing rollers 120C. The attachment holes 130B1 and the inclined portions 130B2 are disposed in parallel at four locations along a longitudinal direction corresponding to each of the couplings for developing rollers 120C disposed at four locations.

The attachment holes 130B1 are formed as long slots in the longitudinal direction, so that the coupling attaching/detaching member 130B can slide in the longitudinal direction, in a state where the couplings for developing rollers 120C are mounted.

The inclined portions 130B2 are formed projectingly, each of which has a same shape, in an upper end side and a lower end side of the coupling attaching/detaching member 130B across the attachment holes 130B1, and are disposed between the driving-side coupling and the driven-side coupling that constitute the couplings for developing rollers 120C.

That is, by sliding the coupling attaching/detaching member 130B to the couplings for developing rollers 120C, the inclined portions 130B2 come into spaces between the driving-side coupling and the driven-side coupling so as to perform attachment/detachment operations of the couplings for developing rollers 120C.

The coupling attachment/detachment driving member 141 is formed in a long rectangular shape in the almost horizontal direction in a state of being mounted on the base plate 111, as shown in FIG. 7, and is provided with an attachment hole **141*a*1 through which the coupling for an intermediate transfer belt 120D is attached, and inclined portions 141*a*2 corresponding to the coupling for an intermediate transfer belt 120**D.

The attachment hole **141*a*1 is formed as a long slot in the longitudinal direction, so that the coupling attachment/detachment driving member 141 can slide in the longitudinal direction, in a state where the coupling for an intermediate transfer belt 120**D is mounted.

The inclined portions **141*a*2 are formed projectingly, each of which has a same shape, in an upper end side and a lower end side of the coupling attachment/detachment driving member 141 across the attachment hole 141*a*1, and are disposed between the driving-side coupling and the driven-side coupling that constitute the coupling for an intermediate transfer belt 120**D.

That is, by sliding the coupling attachment/detachment driving member 141 to the coupling for an intermediate transfer belt 120D, the inclined portions **141*a*2 come into spaces between the driving-side coupling and the driven-side coupling so as to perform an attachment/detachment operation of the coupling for an intermediate transfer belt 120**D.

Next, description will be given for an attachment/detachment operation of the couplings of the driving portion in the process portion **110*a* of the image forming apparatus 100 according to the present embodiment, taking the couplings for photoreceptor drums 120**A as an example.

Figure 8:
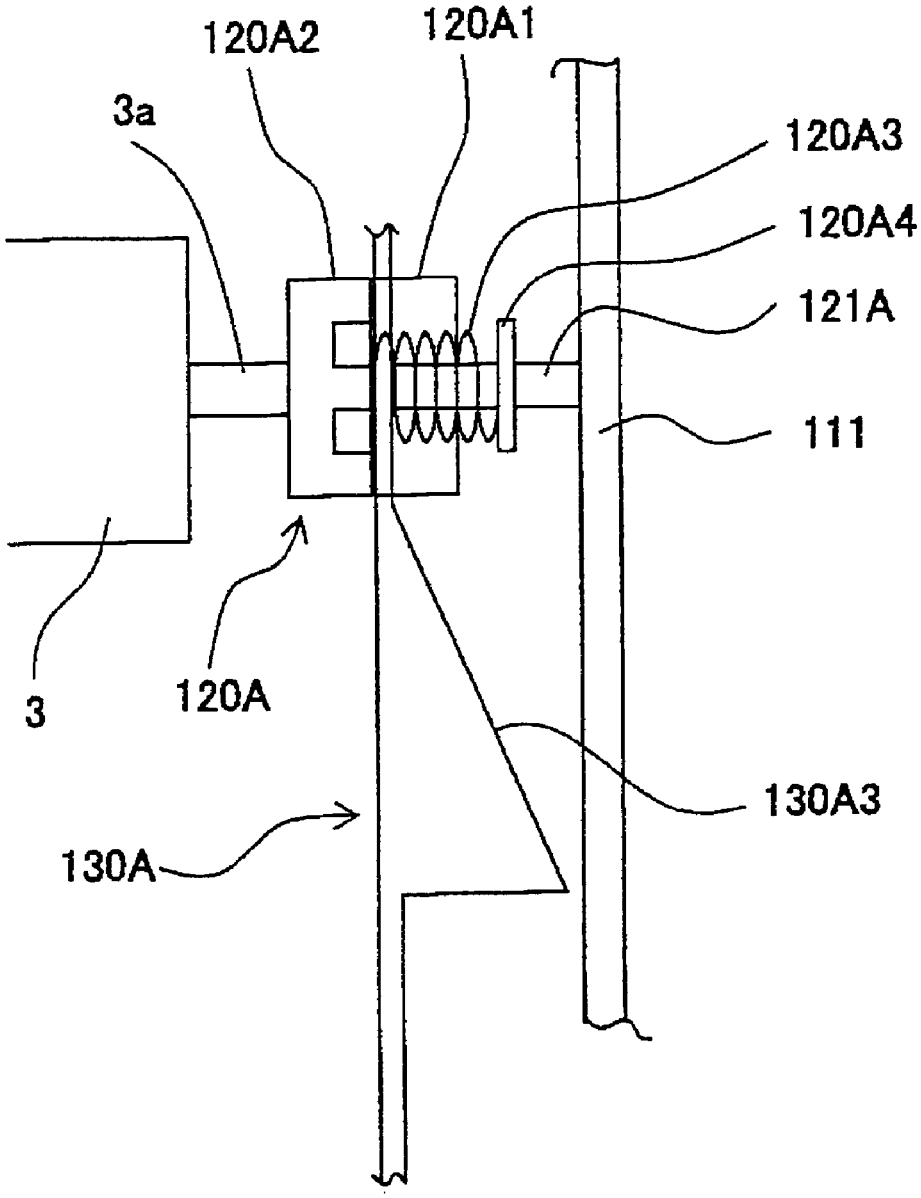
FIG. 8 is an illustrative view showing a state where the coupling for a photoreceptor drum is attached.
Figure 9:
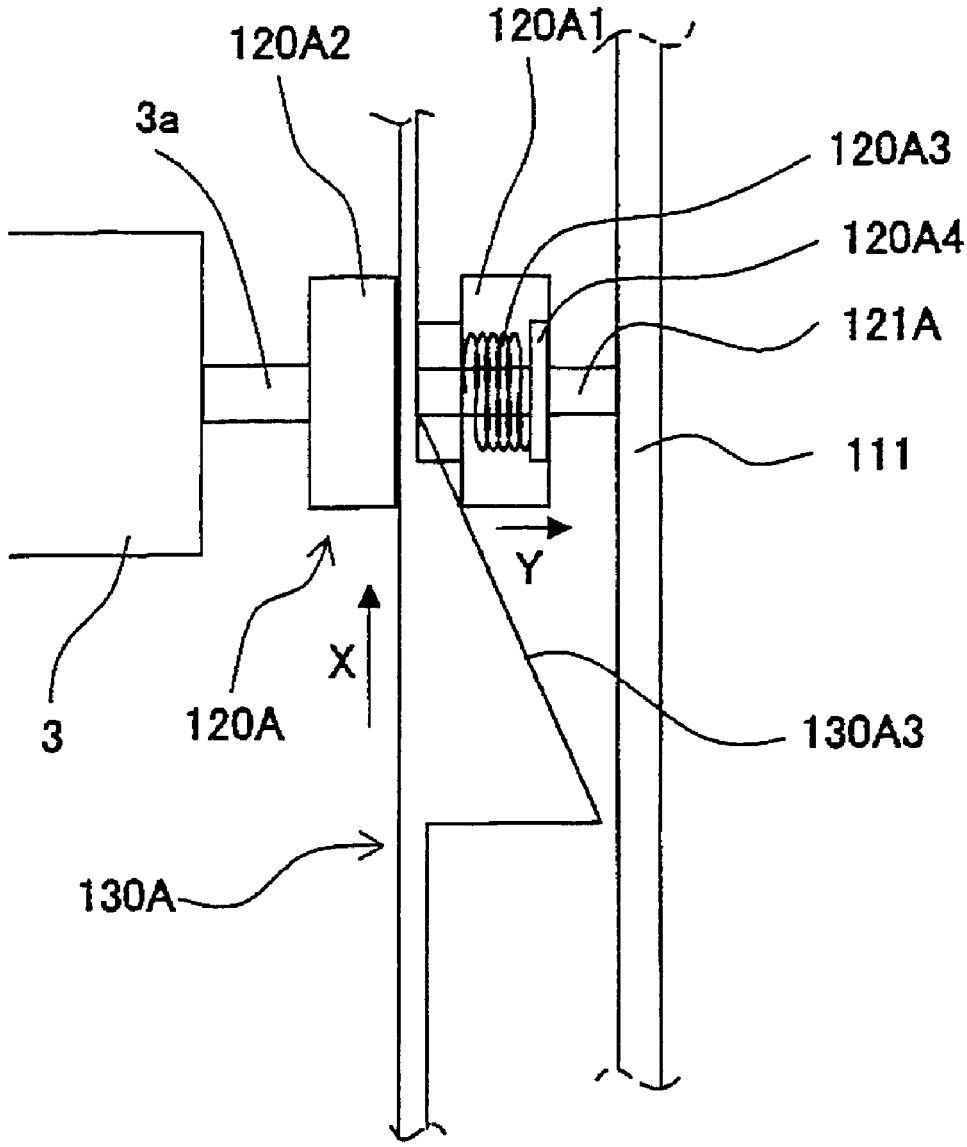
FIG. 9 is an illustrative view showing a state where the coupling for a photoreceptor drum is detached.

FIG. 8 is an illustrative view showing a state where the coupling for a photoreceptor drum is attached, and FIG. 9 is an illustrative view showing a state where the coupling for a photoreceptor drum is detached.

When a driving portion of the photoreceptor drum 3 of the process portion **110*a* in the image forming apparatus 100 is coupled, as shown in FIG. 8, a driving-side coupling 120A1 and a driven-side coupling 120A2, that constitute the coupling for a photoreceptor drum 120**A, are in a coupled state.

The coupling for a photoreceptor drum 120A is provided so that the driving-side coupling 120A1 and the driven-side coupling 120A2 face to each other through the coupling attaching/detaching member 130A.

The driving-side coupling 120A1 is provided so as to be rotatable in association with a driving shaft 121A, and to be movable along a shaft direction of the driving shaft 121A. In addition, the driving-side coupling 120A1 is urged toward the driven-side coupling 120A2 by a compression coil spring 120A3.

The compression coil spring 120A3 is held to the driving shaft 121A by a spring seat 120A4.

The driven-side coupling 120A2 is fixed to a rotational shaft **3*a* of the photoreceptor drum 3**.

The rotational shaft **3*a*** is provided so as to be held rotatably at a predetermined position within the apparatus by a bearing member (not shown) and to be attachable/detachable with respect to the apparatus main body.

The coupling attaching/detaching member 130A is disposed so that the inclined portion 130A3 is positioned so as not to reach the coupling for a photoreceptor drum 120A, when the coupling for a photoreceptor drum 120A is in the coupled state, as shown in FIG. 8.

In the coupling for a photoreceptor drum 120A configured in this way, the driving-side coupling 120A1 is engaged with the driven-side coupling 120A2 by the compression coil spring 120A3 and driving force from the driving shaft 121A is transmitted to the photoreceptor drum 3, in a normal state.

When the coupled state of the driving portion of the photoreceptor drum 3 is released, as shown in FIG. 9, by sliding the coupling attaching/detaching member 130A in a direction indicated by the arrow X, the driving-side coupling 120A1 and the driven-side coupling 120A2 of the coupling for a photoreceptor drum 120A are turned into a detached state.

Specifically, when the coupling attaching/detaching member 130A moves in a direction indicated by the arrow X, the inclined portion 130A3 comes into a space between the driving-side coupling 120A1 and the driven-side coupling 120A2, and the inclined portion 130A3 moves the driving-side coupling 120A1 in an opposite direction to the driven-side coupling side (a direction indicated by the arrow Y), opposing resilient force from the compression coil spring 120A3.

Thereby, the driving-side coupling 120A1 and the driven-side coupling 120A2 are turned into a detached state, and the coupled state of the coupling for a photoreceptor drums 120A is released.

That is, the coupled state of the driving portion of the photoreceptor drums 3 in the process portion **110*a*** is released.

Next, detailed description will be given for a replacement work of a replacement component of the process portion 110*a* in the image forming apparatus 100 according to the present embodiment, with reference to the drawings.

Figure 10:
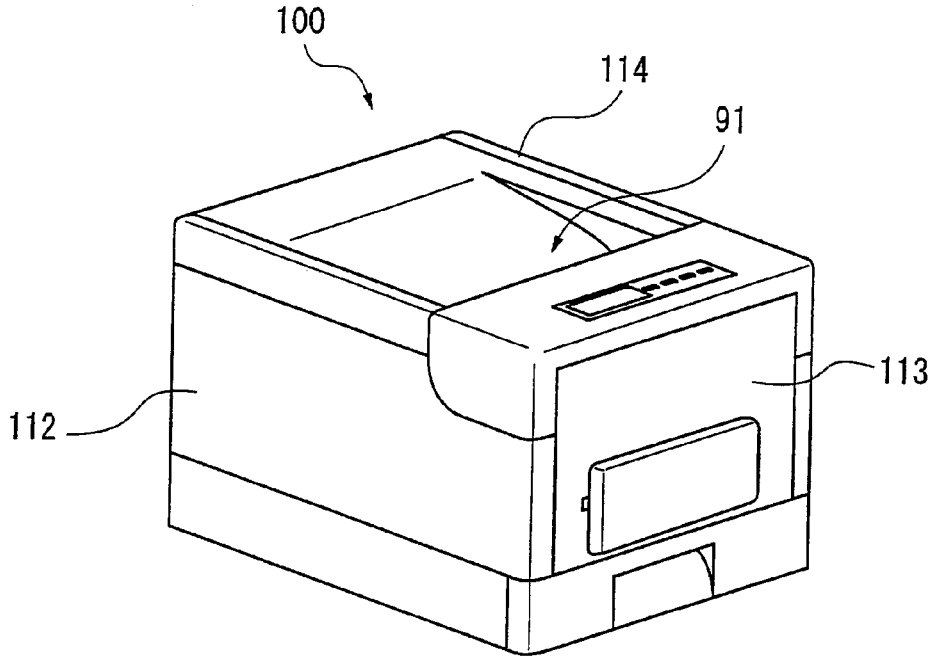
FIG. 10 is an illustrative view showing an overview of the image forming apparatus in a normal state.
Figure 11:
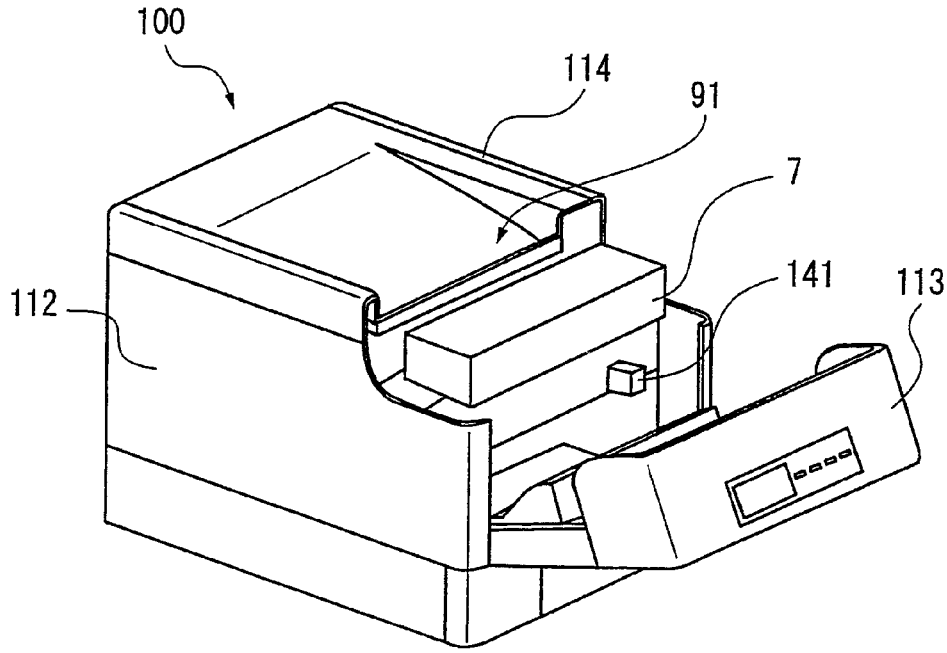
FIG. 11 is an illustrative view showing a state where a front cover of the image forming apparatus is opened.
Figure 12:
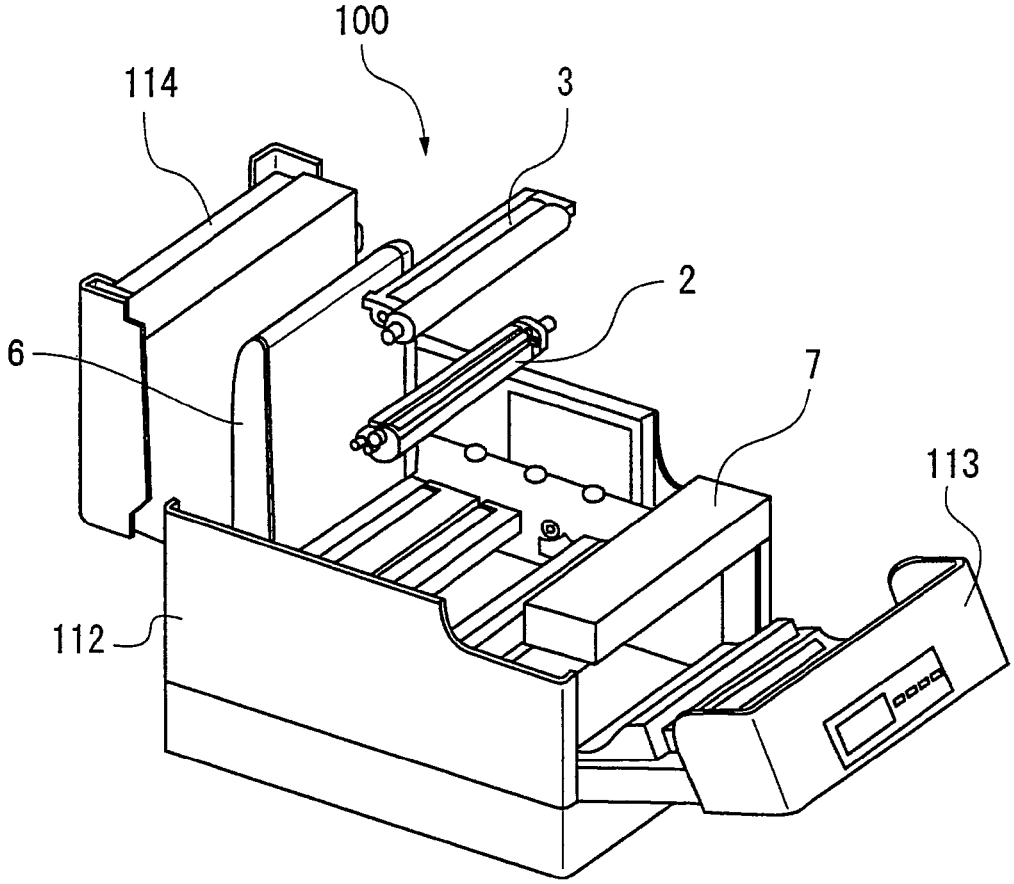
FIG. 12 is an illustrative view showing a state where an upper cover of the image forming apparatus is opened.

FIG. 10 is an illustrative view showing an overview of the image forming apparatus according to the present embodiment in a normal state, FIG. 11 is an illustrative view showing a state where the front cover of the image forming apparatus is opened, an FIG. 12 is an illustrative view showing a state where an upper cover of the image forming apparatus is opened.

As shown in FIG. 10, the image forming apparatus 100 has the front cover 113 in the front side of an outer cover 112 and has an upper cover 114 in the upper side.

As shown in FIGS. 10 and 11, the front cover 113 is brought into contact with the coupling attachment/detachment driving member 141 in a closed state to dispose the coupling attachment/detachment driving member 141 at a predetermined position. The coupling attachment/detachment driving member 141 is brought into contact with the front cover 113 with resilient force of a spring member (not shown). The upper cover 114 is formed with the paper output tray 91.

In the image forming apparatus 100, when a paper jam occurs during sheet transportation or when a replacement component of the process portion 110*a*, such as the photoreceptor drum 3 and the developing unit 2, is replaced, the front cover 113 and the upper cover 114 are opened to carry out a maintenance work.

When the front cover 113 is opened, as shown in FIG. 11, the coupling attachment/detachment driving member 141 that is brought into contact with the front cover 113 with resilient force of a spring member (not shown) moves frontward (to a side of the front cover 113).

Moreover, when the upper cover 114 provided on the upper side of the apparatus main body is opened, as shown in FIG. 12, the coupling attachment/detachment driving member 141 slides frontward, and thereby the coupling for an intermediate transfer belt 120D is detached. Thus, the side of the intermediate transfer belt driving roller 62 (FIG. 1) and the side of the driving shaft are separated.

When the upper cover 114 is opened in a state where the side of the intermediate transfer belt driving roller 62 and the side of the driving shaft are separated, the intermediate transfer belt unit 6 rotates upward in association with the opening operation, as shown in FIG. 12. With the upward rotation of the intermediate transfer belt unit 6, the upper side of the photoreceptor drum 3 and the developing unit 2 is opened so that the photoreceptor drum 3 and the developing unit 2 are in an attachable/detachable state.

On the other hand, when the coupling attachment/detachment driving member 141 moves frontward, the interlocking gear 142 rotates to slide the coupling attaching/detaching member 130A. When the coupling attaching/detaching member 130A slides, the interlocking gear 143 rotates to slide the coupling attaching/detaching member 130B.

When the coupling attaching/detaching members 130A and 130B slide, the coupling for a photoreceptor drum 120A for transmitting driving to the photoreceptor drum 3 and the coupling for a developing roller 120C for transmitting driving to the developing unit 2 are detached so that the photoreceptor drum 3 and the developing unit 2 are separated from the driving portion. Thereby, the photoreceptor drum 3 and the developing unit 2 are turned into an attachable/detachable state, thus making it possible to perform a replacement work easily.

With the configuration as described above, according to the present embodiment, the image forming apparatus 100 includes the couplings for photoreceptor drums 120A, the couplings for waste toner transporting screws 120B, the couplings for developing rollers 120C, and the coupling for an intermediate transfer belt 120D, that transmit driving to the process portion 110*a*, and the coupling attaching/detaching members 130A and 130B that attach/detach these coupling members and the coupling attachment/detachment driving member 141, wherein the coupling attaching/detaching members 130A and 130B and the coupling attachment/detachment driving member 141 are configured so as to be slidable independently, the coupling attaching/detaching member driving mechanism 140 is provided so as to operate the coupling attaching/detaching members 130A and 130B and the coupling attachment/detachment driving member 141 in association with one another, resulting that it is possible to attach/detach the plurality of coupling members reliably without increasing the number of components and enlarging the image forming apparatus, with an simple structure.

Furthermore, according to the present embodiment, the coupling attachment/detachment driving member 141 is provided so as to slide in association with the open operation of the front cover 113, thus making it possible to perform the attachment/detachment operation of the coupling for an intermediate transfer belt 120D easily without being provided with another driving means, and to slide the coupling attaching/detaching members 130A and 130B.

Furthermore, according to the present embodiment, the rack gears G1 to G4, the first interlocking gear 142, and the second interlocking gear 143 are provided as a driving transmission member for transmitting driving force of the coupling attaching/detaching members 130A and 130B and the coupling attachment/detachment driving member 141, thus making it possible to easily perform the attachment/detachment operations of the couplings with a simple structure and space saving, and without being provided with another driving means.

Furthermore, since the coupling attaching/detaching members 130A and 130B and the coupling attachment/detachment driving member 141 are provided independently, it is possible to adjust initial positions (engagement positions of the couplings) of the couplings for photoreceptor drums 120A, the couplings for waste toner transporting screws 120B, and the couplings for developing rollers 120C with respect to the first interlocking gear 142 and the second interlocking gear 143, and to easily adjust a distance perpendicular to a movement direction of the coupling attaching/detaching members 130A and 130B, that is, a displacement amount when the driving-side coupling and the driven-side coupling are attached/detached, thus making it possible to reliably perform the attachment/detachment operations of the coupling members.

Furthermore, according to the present embodiment, the coupling attaching/detaching members 130A and 130B are formed with a plurality of inclined portions 130A2, 130A3, and 130B2, and the attachment/detachment operations of each plurality of the couplings for photoreceptor drums 120A, the couplings for waste toner transporting screws 120B, and the couplings for developing rollers 120C are performed simultaneously, thus the attachment/detachment operations of the plurality of coupling members can be performed reliably and sharing of components makes it possible to suppress increasing in the number of the components and in the size of the apparatus.

Note that, in the aforementioned embodiment, description has been given for the driving portion of the process portion 110*a* in the electrophotographic image forming apparatus 100 capable of performing color image formation, but the present invention will not be limited to the image forming apparatus that is configured as described above and can be developed into image forming apparatuses having other configuration. For example, it is also applicable to an electrophotographic image forming apparatus capable of performing only monochrome image formation.

As described above, the present invention will not be limited to the aforementioned embodiment and various changes can be made without departing from the scope of the invention. That is, an embodiment obtained by combining technical means varied within the scope of the invention is included in the technical scope of the present invention.

What is claimed is:

1. An image forming apparatus that drives a process portion for performing image formation by an electrophotographic method, comprising:

a plurality of coupling members for transmitting driving force to each of a plurality of driving shafts that drive the process portion;

a plurality of coupling attaching/detaching members for attaching/detaching the plurality of coupling members; and a coupling attaching/detaching member driving mechanism for operating the plurality of coupling attaching/detaching members in association with each other, wherein the coupling member is configured by a driving coupling and a driven coupling, and the plurality of coupling attaching/detaching members are provided so as to be movable independently;

wherein:

the coupling attaching/detaching member has a function of performing attachment/detachment operations of the plurality of coupling members simultaneously; and the process portion includes a plurality of photoreceptor drums having toner images formed thereon and a plurality of cleaning apparatuses for removing toner remaining on the photoreceptor drums, the cleaning apparatuses include waste toner transporting screws for transporting collected waste toner, and includes, as the plurality of driving shafts, driving shafts of the plurality of the photoreceptor drums and driving shafts of the plurality of waste toner transporting screws, and among the plurality of coupling attaching/detaching members, the first coupling attaching/detaching member attaches/detaches coupling members of the driving shafts of the plurality of photoreceptor drums and coupling members of the driving shafts of the plurality of waste toner transporting screws.

2. The image forming apparatus according to claim 1, wherein the coupling attaching/detaching member driving mechanism includes an interlocking member that operates in association with an open/close operation of a cover that covers the process portion, and the interlocking member drives the coupling attaching/detaching member in association with the open/close operation of the cover to perform an attachment/detachment operation of the coupling member.

3. The image forming apparatus according to claim 1, wherein the coupling attaching/detaching member driving mechanism includes a driving transmission member that transmits driving force, among the plurality of coupling attaching/detaching members, to a second coupling attaching/detaching member through a first coupling attaching/detaching member.

4. The image forming apparatus according to claim 3, wherein the driving transmission member is an intermediate gear that transmits driving force so that an operating direction of the first coupling attaching/detaching member is opposite to an operating direction of the second coupling attaching/detaching member.

5. The image forming apparatus according to claim 1, wherein the process portion includes a plurality of developing rollers for supplying toner to the photoreceptor drums, and includes, as the driving shafts, driving shafts of the plurality of photoreceptor drums and driving shafts of the plurality of developing rollers, and among the plurality of coupling attaching/detaching members, the first coupling attaching/detaching member attaches/detaches coupling members of the driving shafts of the plurality of photoreceptor drums and the second coupling attaching/detaching member attaches/detaches coupling members of the driving shafts of the plurality of developing rollers.

6. The image forming apparatus according to claim 2, wherein the image forming apparatus includes a transfer portion for transferring the toner images formed on the photoreceptor drums through an intermediate transfer belt onto a recording medium, and the interlocking member drives the coupling attaching/detaching member in association with the open/close operation of the cover to performs the attachment/detachment operation of the coupling member for transmitting driving force to a driving shaft of the intermediate transfer belt.

* * * * *